United States Patent [19]

Cederholm

[11] Patent Number: 4,981,002

[45] Date of Patent: Jan. 1, 1991

[54] WALL SYSTEM

[75] Inventor: Lars Cederholm, Ängelholm, Sweden

[73] Assignee: Termofrost AB, Kista, Sweden

[21] Appl. No.: 324,759

[22] Filed: Mar. 17, 1989

[30] Foreign Application Priority Data

Mar. 18, 1988 [SE] Sweden ..... 8801001

[51] Int. Cl.[5] ..... E04B 2/78

[52] U.S. Cl. ..... 52/241; 52/238.1; 52/282

[58] Field of Search ..... 52/282, 281, 243, 238, 52/239, 241, 475

[56] References Cited

U.S. PATENT DOCUMENTS

| | | | |
|---|---|---|---|
| 3,513,606 | 5/1970 | Jones | 52/243 |
| 3,834,092 | 9/1974 | Whisson | 52/282 |
| 4,101,231 | 7/1978 | Streib | 52/282 |
| 4,458,461 | 7/1984 | Holley | 52/241 |

*Primary Examiner*—Michael Safavi

*Attorney, Agent, or Firm*—Nies, Kurz, Bergert & Tamburro

[57] ABSTRACT

A wall system comprises hollow framework structural members which can be assembled to form a hollow framework and subsequently disassembled, and transparent and opaque wall elements, the framework being intended to support the wall elements. The hollow framework structural member comprise vertical studs and horizontal battens. The invention is characterized in that each of the studs comprises a stud profile (5) and an end-piece the upper and the lower end of the stud profile; in that channels (7) are distributed peripherally around and along the profile; in that recesses are provided peripherally around the end-pieces; in that the channels (7) and the recesses are distributed uniformly and equidistantly around respective peripheries, the channels (7) and the recesses being at least eight in number and being intended to lie in register with one another; and in that one or more battens is, are, intended to be fitted into recesses of one and the same end-piece; and in that the vertical edge of a wall element supported by respective battens extends along respective channels (7) in the stud profile (5).

7 Claims, 3 Drawing Sheets

WALL SYSTEM

The present invention relates to a wall system and more specifically, but not exclusively to a wall system which comprises hollow framework structural members, which can be assembled to form a hollow framework and subsequently disassembled, and transparent or opaque wall elements of various kinds.

Many different hollow framework systems are known to the art, these systems being intended, among other things, for the construction of wall configurations in trade fair facilities, departmental stores, shops, etc. . . The known systems include a wide variety of components, from which it is necessary to choose when constructing a partition wall, partiioning off a room-like space, or building some other wall construction of given configuration, or of given appearance, etc. . .

Among other things, various types of angle pieces are required, depending on the angle defined by two mutually adjacent wall elements, as seen in horizontal section.

This problem is solved by the present invention in that the inventive system comprises only a small number of basic components and in that it enables highly variable hollow framework structures to be be built, and subsequently dismantled, both easily and speedily, despite the relatively few basic components of the system.

The present invention thus relates to a wall system which includes hollow framework structural members, which can be both assembled and disassembled, and transparent and opaque wall elements, the hollow frame structure constructed from said members being intended to support said wall elements and said members including vertical posts or studs and horizontal battens which are intended to extend horizontally between the studs, the wall system being characterised in that each of the studs comprises a stud profile which has an end-piece at the upper and the lower end thereof, in that the stud profile exhibits channels which extend along said profile and which are distributed around the periphery thereof, in that the end-pieces have recesses which are distributed around the periphery thereof; in that the channels and recesses are distributed uniformly and equidistantly around respective peripheries, said channels and recesses being at least eight in number and being intended to lie in register with one another, in that one or more of said battens is, are, intended to be fitted to recesses in one and the same end-piece, and in that the vertical edges of each wall element supported by repective battens extend along corresponding channels in the stud profile.

The invention will now be described in more detail with reference to an exemplifying embodiment thereof illustrated in the accompanying drawings, in which FIG. 1 is a sectional view taken on the line A—A in FIG. 2 and shows a lower part of a vertical stud profile and a part of a horizontal batten;

Figure 9:
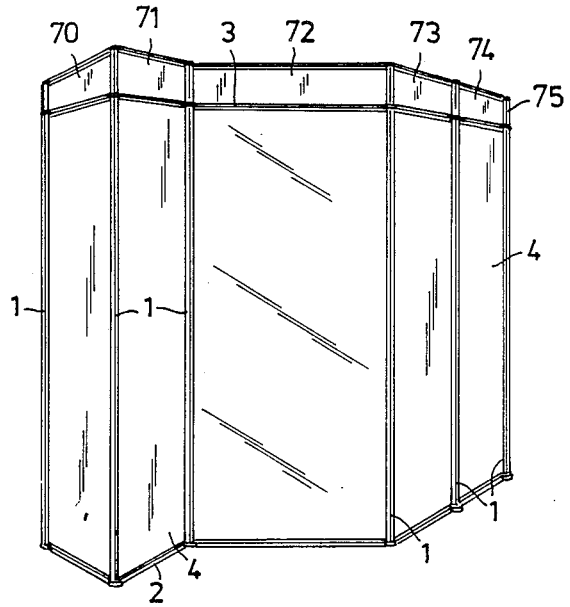
FIG. 9 is an exemplifying perspective view of an assembled inventive wall system.

FIG. 9 illustrates schematically and by way of example a wall which has been constructed from a wall system in accordance with the present invention. The wall system comprises hollow framework structural members which can be assembled to form a hollow framework and subsequently dismantled and which include studs, or vertical posts, 1 and horizontal battens 2, 3. The framework is intended to support wall elements 4, which may be transparent or opaque.

Figure 2:
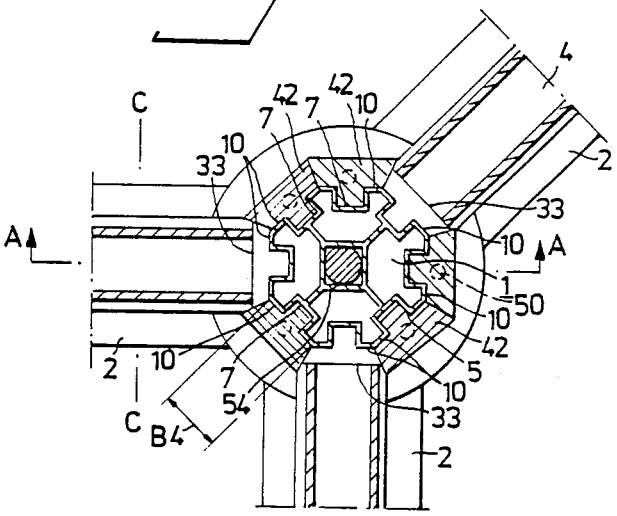
FIG. 2 is a sectional view taken on the line B—B in FIG. 1 and shows a lower part of a vertical stud and parts of three horizotal battens.

Each of the studs 1 includes a stud profile 5, see FIG. 2, and an end-piece 6 provided at the upper and the lower end of the stud profile 5.

Disposed peripherally around and along the stud profile 5 are channels 7.

Figure 6:
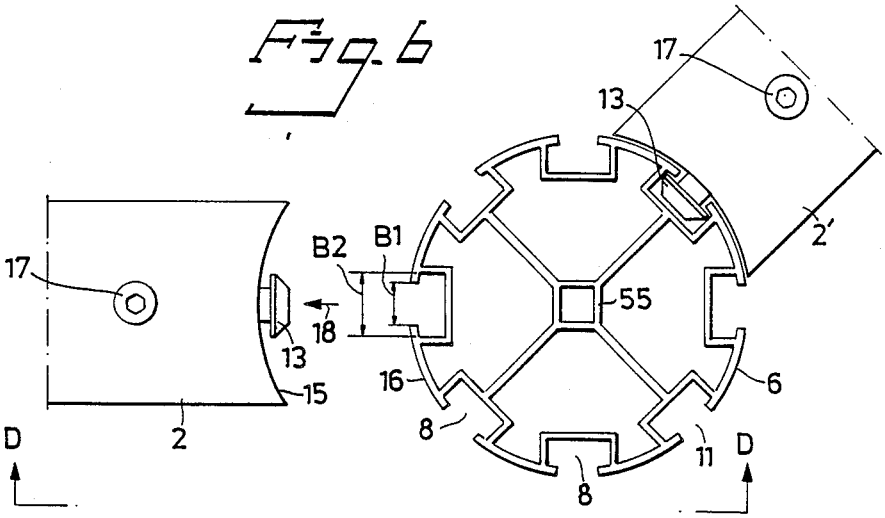
FIG. 6 shows an end-piece from above, and two horizontal battens.

The end-pieces 6, see FIG. 6, have recesses 8 distributed around the periphery thereof.

Both the channels 7 of the stud profile 5 and the recesses 8 in the end-pieces 6 are distributed evenly and equidistantly around respective peripheries. The channels 7 and the recesses 8 are at least eight in number, as explained in more detail herebelow. Although this number may be larger, eight is the number preferred.

In the assembled state, the channels 7 and the recesses 8 are intended to lie in register with one another.

The horizontal battens 2, 3 are intended for connection to one or more of the recesses 8 of the end-pieces 6, such that the vertical edge of the wall element supported by a respective batten 2, 3, will extend along corresponding channels in the stud profile 5.

According to one preferred embodiment, the stud profile 5 has an equilateral polygonal shape in cross-section. The channels 7 have a U-shape cross-section and one channel is formed in each side 10 of the polygon; see FIG. 2.

The end-piece 6 is preferably of circular cross-section or substantially of circular cross-section. The recesses 8 are substantially U-shaped, and the gap 11 of each recess has a width B1, which is smaller than the largest width B2 of said recess; see FIG. 6.

Each batten has provided at respective ends thereof a fastener device, shown generally at 12, for fastening the ends of respective battens in two respective end-pieces 6 at two opposing stud profiles 5.

Figure 5:
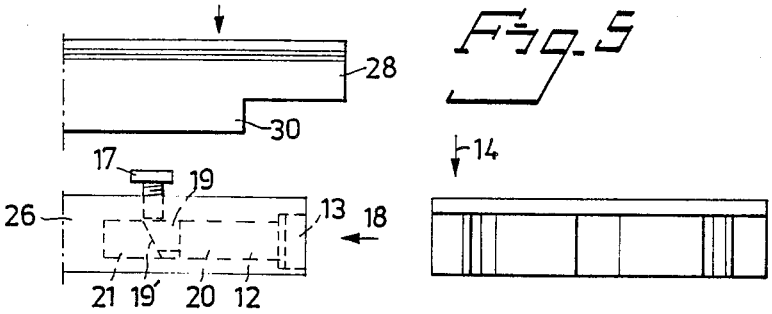
FIG. 5 is a view corresponding to the view D—D in FIG. 6 and shows in side view an end-piece and part of a horizontal batten.

The fastener device 12 includes a substantially T-shaped part 13 which is intended to be fitted into an appropriate recess 8, as illustrated in FIGS. 5 and 6.

The T-shaped part 13 of the fastener device 12 of respective battens 2, 3 is inserted into the recess 8, e.g. from above, as shown by the arrow 14 in FIG. 5. In this respect, a curved surface 15 provided on the batten close to the outer surface 16 of the end-piece 6, said end-piece preferably having the same radius as the radius of curvature of the curved surface 15 of the batten; see the batten 2' in FIG. 6.

The fastener device is constructed in a suitable known manner, such as to enable the T-shaped part 13 to be drawn-in in the direction of the arrow 18, with the aid of a screw or a box spanner, thereby to pull the batten into firm abutment with the end-piece 6.

FIG. 5 illustrates schematically an embodiment of the fastener device in which the screw 17 acts against a conical element 19, which in turn acts against a sloping surface 19' in a hole provided in a rod 20 attached to the T-shaped part. When the screw 17 is screwed downwards in FIG. 5 and acts against the left-hand oblique edge 21 of the hole 19, the rod 20, and therewith also the T-shaped part 13, will be drawn in the direction of the arrow 18. However, other means may be used for pulling the rod 20 in the direction of the arrow 18. For example, a lever arm mechanism can be used to this end. Alternatively, the rod 20 may be biassed by a spring means, such that when being fitted to an end-piece, the T-shaped part is pulled out against the force of the spring and displaced down into the recess 8 concerned.

Figure 3:
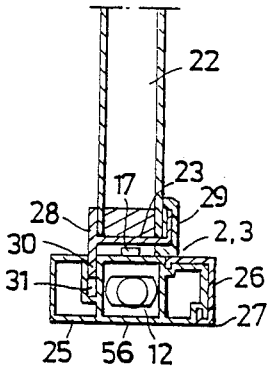
FIG. 3 is a sectional view taken on the line C—C in FIG. 2.

The battens 2, 3 are substantially U-shaped in section, see FIG. 3. According to one embodiment, the width of the U is adapted to accommodate a double-pane sealed glazing unit 22 or some other kind of glass pane structure.

Preferably, opaque wall elements or panels, such as board, plastic sheets or sheet laminates are given the same thickness as the type of glass pane to be used, and that the width 23 of the U of the battens corresponds to this thickness.

According to one embodiment, a batten 2, 3 comprises several parts. The basic part of the batten 2, 3 is a profile 25, see FIGS. 3 and 5, in which the fastener device 12 is secured. This profile is preferably an extruded aluminium section.

The profile 25 has a plastic profile 26 snapped onto one side thereof. The plastic profile 26 may be provided with a soft lip 27 on one edge thereof, so as to seal against, e.g., a floor surface.

The aforementioned U-shape 23 is defined by a T-shape profile 28, which is preferably also an extruded aluminium section. Snapped onto one side of the last mentioned profile is plastic profile 29 which conforms to the first mentioned plastic profile 26. In assembly, a vertically positioned leg 30 of the profile 28 is inserted into a corresponding channel 31 in the profile 25. A wall element, such as a double glazed sealed unit 22, is also inserted into the U-shape 23 formed by the profile 28.

FIG. 5 shows the profile 28 before it has been moved down into the channel 31 of the profile 26.

Preferably, the wall system is such that the lower horizontal battens 2 and the upper horizontal battens 3 are of identical configuration, so that the upper battens need only be twisted, in order for the U-shape to face downwards.

Furthermore, identical end-pieces 6 are used at the lower and the upper ends of each stud profile 5.

Figure 1:
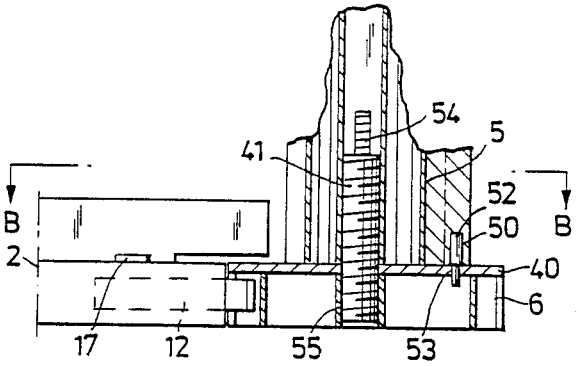

As illustrated in FIG. 1, an insert plate 40 is located between a stud profile 5 and its end-piece 6. When fitted, this insert plate 40 will cover those end-piece surfaces which face towards the stud profile and prevent the T-shaped part 13 of the fastener device 12 from being withdrawn from an associated recess 8.

In assembly, the stud profiles 5 and the end-pieces 6 are connected together by means of a bolt 41 passing through the insert plate 40. The bolt 41 co-acts with a screw threaded section 54; 55 in the stud profile 5 and the end-pieces 6 respectively.

As illustrated in FIG. 2, it is evident that the vertical sides of each wall element 4 supported by battens will extend along a channel 7 in the stud profile 5.

According to one preferred embodiment, profiled strips 42 are provided for co-action with those channels 7 in the stud profile 5 which are located between the channel or channels along which wall elements extend, see FIG. 2.

Figure 4:
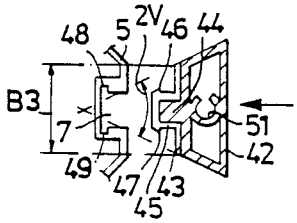
FIG. 4 is a detailed view of a profile strip and associated channels in a vertical stud profile.

As shown in FIG. 4, the profile strips 42 have a cross-section profile which is essentially a truncated triangle with equal base angles, the effective convergent angle 2 V of which (see FIG. 4) is equal to 360° divided by the number of channels 7 in the stud profile, and the truncated surface 43 of which has a width B3 which corresponds to the width B3 of one side 10 of the stud profile 5.

The profile strips are preferably extruded aluminium strips. The profile strips 42 are provided with a projection 44 which extends along the length of the strip and which is intended to co-act with channel 7 in the stud profile 5.

In accordance with the FIG. 4 embodiment, the projection 44 is fitted with plastic cover strip 45, which may be provided with tongues for co-action with notches or like recesses 48, 49 at the bottom of channels 7, in a manner to secure the profile strips 42 to the stud profile 5.

The profile strips 42 are provided with holes 50 (see FIG. 2) at both ends thereof, or with an open, cicular profile part 51 (see FIG. 4) which extends along the length of the profile.

According to one embodiment, a pin 52, see FIG. 1, extends from said holes 50, 51 in the profile strip and through a hole 53 in the insert plate 40, such as to lock the upper and the lower ends of the profile strips in position relative to one another and to the stud profile 5.

The wall system is erected or assembled in the following manner.

A number of lower battens 2 are secured in a number of end-pieces 6 with the aid of fasteners 12. Bolts 41 are then screwed into the end-pieces and insert plates 40 are fitted.

Stud profiles are then threaded onto the bolts 41. Wall elements 4 are placed in the U-channels 23 of the lower battens 2 at this stage of the erection process.

The upper battens 3 are then fitted to onto the wall elements.

Pins 52 are inserted into the lower insert plate 40 and profile strips 42 are fitted onto the pins. Similarly, further pins are inserted into the upper insert plate and profile strips, such as to secure the strips to the upper end of the stud profile. The upper bolt is also fitted together with upper end-piece.

As previously mentioned, the upper and the lower insert plate, the bolt, the end-piece, and the pins are all mutually identical and are used in precisely the same way at the upper and the lower end of the stud profile.

The upper and the lower battens are also mutually identical, with the exception of one detail. In the case of the lower battens, the screw 17 of the fastener 12 can be reached through a hole (not shown) located in the bottom of the U-shaped part 13, see FIG. 3, and hence the battens are tightened against the end-piece by means of the screw 17 and the T-shaped part 13, before fitting the wall element.

In the case of the upper battens, on the other hand, the fastener device 12 is rotated 180° about its axis, so that the screw faces upwards. Although not shown, a hole is provided in that part of the batten referenced 55 in FIG. 3. Thus, in the case of the upper battens, the screw 17 is accessible from above, the U-shaped 23 part of which faces downwards.

However, the upper and the lower battens may be given the same configuration, whereby holes are provided in both the part 56 and in the bottom of the U-shaped part 23. In this case, the fastener device 12 can be inserted into a batten from either direction and manipulated through either of the holes in the batten.

Subsequent to fitting the upper end-piece, the upper battens are fitted to the end-pieces and secured relative thereto by means of the T-shaped part 13, as illustrated in FIG. 6.

The structure is dismantled in the reverse order.

It will be seen that the inventive system can be erected and dismantled quickly and easily, owing to the small number of structural components involved.

Figure 7:
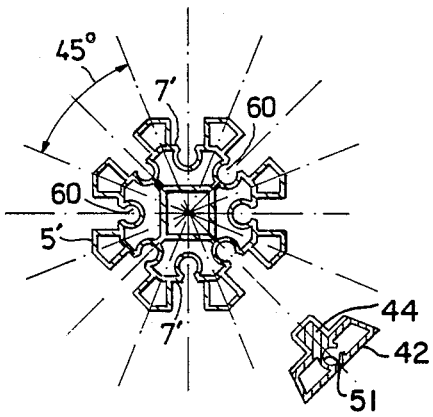
FIG. 7 is a cross-sectional view of an alternative embodiment of a stud profile.

FIG. 7 is a cross-sectional view which illustrates an alternative embodiment of the stud profile, here referenced 5'.

Figure 8:
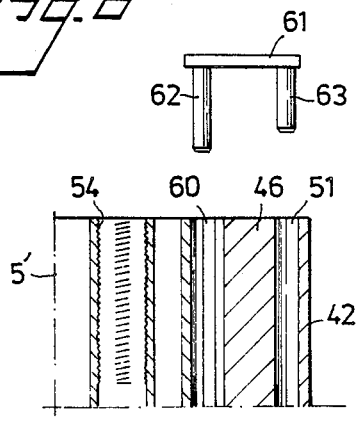
FIG. 8 is a sectional view of an upper part of a stud profile and a profile strip, together with a locking element.

According to this embodiment, the stud profile 5' is provided, inwardly of the U-shaped channel 7', with a further channel 60, which extends along the stud profile 5'. The profile strips are provided at their ends with the aforesaid holes 50, 51. The above mentioned pins 52 (see FIG. 1) are not used in the case of this embodiment, but instead there is used a U-shaped locking element 61, see FIG. 8. Shown in FIG. 8 is the upper part of a stud profile 5', in which the screw threaded hole for bolt 41 is referenced 54. The hatched area illustrates a profile strip 42 according to FIG. 4.

The legs 62, 63 of the locking element are intended to co-act with the outer channel 60 in the stud profile and with the hole 51 in the profile strip respectively, so as to lock the profile strip to the stud profile. In the case of this embodiment, the insert plate 40 (see FIG. 1) will be shaped so that the bridge of the U-shaped locking element 61 is located between the end-piece 6 (see FIGS. 1 and 10) and the insert plate 40.

According to one preferred embodiment, the profile strips are slightly curved in their longitudinal direction, i.e. in the shape of a bow, such that the profile strips will tightly abut the stud profile, when the upper and the lower ends of the profile strips are tensioned in against the stud profile.

The ancillary chain lines in FIG. 7 are intended to show that in the case of the preferred embodiment, the eight channels 7' are disposed uniformly around the periphery of the stud profile and are thus spaced at a mutual angle of 45°.

It will clearly be seen, inter alia from FIGS. 2, 6, and 7, that wall elements can be fitted to a stud profile at a mutual smallest angle of 45° and that more than one wall element can be fitted. For example, three or four wall elements can be fitted to one stud profile.

Thus, one or more wall structures of widely differing appearance can be erected with the same starting components.

Furthermore, transparent and opaque wall elements can be used, which means, in combination with the aforesaid possibilities of variation, that the walls can be adapted to the purpose intended, the area available and its format, etc., at the site of erection or assembly.

By providing the stud profile with eight channels and the end-pieces with eight recesses in the aforesaid manner, the advantage is afforded that the a wall element can be fitted to a stud profile at angular intervals of 45°. However, more channels, and recesses may be provided, e.g. sixteen.

Thus, these embodiments mean that it is not imperative to fit wall elements at right angles to one another, and that it is not necessary to use different angle pieces because of the angle which is chosen between adjacent wall elements.

FIG. 9 illustrates an upper wall part 70–74. This upper wall part can be constructed by screwing the upper bolt 41 through the upper end-piece, so that a furthe end-piece and a further, but shorter stud profile 75 can be fitted and secured on top of the first mentioned upper end-piece. In other respects, the upper wall part is constructed in the manner of the wall described above.

Thus, it is possible to construct a wall where two or more wall elements are placed one above the other with the aid of intermediate, horizontal battens.

Figure 10:
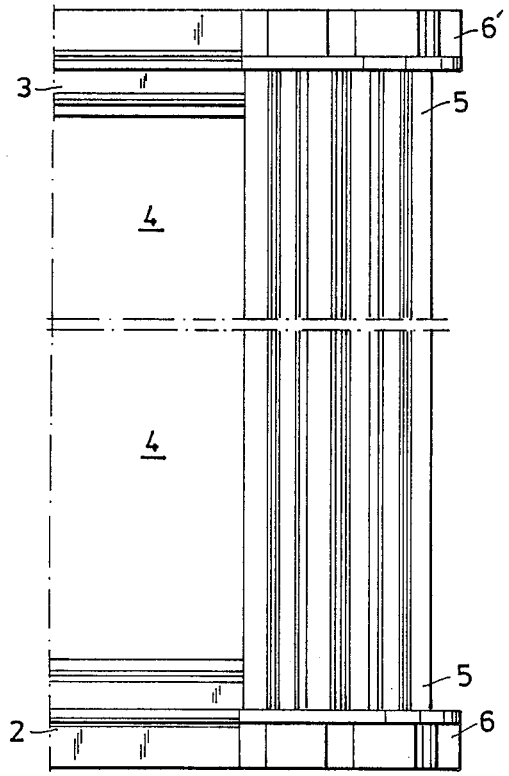
FIG. 10 is a side view of a part of an upper and a lower batten and a stud profile.

FIG. 10 is a side view of a stud profile 5 and parts of a lower 2 and an upper 3 batten in an assembled state, where the lower end-piece is referenced 6 and the upper end-piece is referenced 6'.

As will be readily understood, the present invention provides a highly flexible wall system which has only a few components, which can be quickly assembled and dismantled, and which has a pleasing and attractive appearance in its erected state.

A number of embodiments have been described in the aforegoing.

It will be understood by those skilled in this art, however, that the structural configuration of the stud profiles, the battens, and the end-pieces can be modified without departing from the function principle described above.

The present invention shall not therefore be considered restricted to the above embodiments thereof, since modifications can be be made within the scope of the following claims.

I claim:

1. A wall system including hollow framework structural members which can be assembled to form a hollow framework and subsequently disassembled, and transparent and opaque wall elements, said hollow framework being intended to support said wall elements, said structural members comprising studs or posts which are intended to extend vertically, and battens which are intended to be placed horizontally between the studs, characterised in that each of said studs includes a stud profile (5, 5') and an end-piece (6,6') at the upper and the lower ends respectively of the stud profile; in that the stud profile (5, 5') has channels (7) distributed around the periphery thereof and extending along the length thereof; in that the the end-pieces (6, 6') have recesses (8) distributed around the periphery thereof; in that the channels (7) and the recesses (8) are distributed uniformly and equidistantly around respective peripheries, said channels (7) and recesses (8) being at least eight in number and being intended to lie in register with one another; in that one or more battens (2, 3) are intended to be fitted into recesses (8) of one and the same end-piece (6, 6'); and in that the vertical edge of a wall element supported by respective battens extends along a corresponding channel (7) in the stud profile (5,5').

2. A wall system according to claim 1, characterised in that said stud profile (5,5') in cross section has an equilateral, polygonal shape; in that said channel (7) is of U-shaped cross-section; and in that a channel is provided in each side of the polygon.

3. A wall system according to claim 1 characterised in that the system further includes profile strips (42) which are intended to co-act with those channels (7) of the stud profile (5, 5') which are located between the channel or channels (7) along which the wall element (4) extends.

4. A wall system according to claim 3, wherein the profile strips (42) have a cross-section which is a truncated triangle with equal base angles, the effective convergent angle (2 V) of which is equal to 360° divided by the number of channels (7) in the stud profile (5, 5'), and the truncated surface (43) of which has a width which corresponds to the width of one side of the stud profile (5, 5').

5. A wall system according to claim 1, characterised in that each end-piece (6, 6') has in cross-section a fully circular, or essentially a fully circular shape; in that said recesses (8) are substantially U-shaped, where each recess has a gape width (B1) which is smaller than the largest width (B2) of the recess (8); and in that the system also includes a fastener device (12) which comprises a substantially U-shaped part (13) which is intended to be fitted into the recess (8), one such fastener device being provided at each end of each batten (2, 3).

6. A wall system according to claim 1, characterised in that said battens (2, 3) are substantially of U-shaped cross-section, and in that the width of the U is adapted to the thickness of the wall element.

7. A wall system according to claim 3, wherein means adjacent each of the upper and lower ends of the stud profile, including said end pieces, said upper and lower ends of the stud profile and the adjacent ends of each said profile strip, structurally interlock said profile strips and said stud profile and maintain each said profile strip in its associated said channel in said stud profile.

* * * * *